US005170142A

United States Patent [19]

Bier

[11] Patent Number: 5,170,142

[45] Date of Patent: Dec. 8, 1992

[54] RADIO FREQUENCY FEEDTHROUGH SEAL AND METHOD

[75] Inventor: Larry J. Bier, San Jose, Calif.

[73] Assignee: Watkins-Johnson Company, Palo Alto, Calif.

[21] Appl. No.: 756,462

[22] Filed: Sep. 9, 1991

[51] Int. Cl.[5] ..... H01P 1/00

[52] U.S. Cl. ..... 333/245; 333/260; 333/248

[58] Field of Search ..... 333/245, 246, 247, 248, 333/260, 263, 254, 255, 24 R, 182, 236; 361/392

[56] References Cited

U.S. PATENT DOCUMENTS 4,507,708 3/1985 Lindberg ..... 333/260 X

*Primary Examiner*—Eugene R. LaRoche
*Assistant Examiner*—Ali Neyzari
*Attorney, Agent, or Firm*—Flehr, Hohbach, Test, Albritton & Herbert

[57] ABSTRACT

A hermetically sealed radio frequency feedthrough device is disclosed. The feedthrough includes a first ring of a glass material which bonds to a radio frequency device housing when heated. A second ring is also provided, the second ring does not melt and thereby contains the glass material to desired areas during heating.

7 Claims, 2 Drawing Sheets

RADIO FREQUENCY FEEDTHROUGH SEAL AND METHOD

BRIEF DESCRIPTION OF THE INVENTION

The present invention relates generally to a hermetically sealed radio frequency feedthrough. Specifically, the invention relates to a glass sealed radio frequency feedthrough and a method of forming such a feedthrough.

BACKGROUND OF THE INVENTION

High reliability radio frequency devices are packaged in hermetically sealed housings. To allow the transmission of radio frequency signals into and out of these housings, hermetically sealed feedthroughs are necessary. These feedthroughs must have proper electrical performance characteristics, while providing a hermetic seal of a reliable nature. Packages with these feedthroughs are used in communications satellites, microwave communications equipment, and military communications and radar systems which require a hermetic seal to avoid contaminating the RF devices inside.

These feedthroughs form a coaxial transmission line through the housing wall and into the cavity containing the RF devices. The coaxial line is comprised of a conductive center pin and a surrounding cylinder of dielectric material. The dielectric material is one of low loss tangent, such as glass. The outer conductor of the coaxial line is formed by the housing wall. To create a better transition of the radio frequency signal to the components within the device, the glass section is followed by an airline section which uses air as the dielectric material.

In order to seal the feedthrough to the RF housing, the feedthrough is heated, causing the glass cylinder to melt and then bond to the housing and the center pin, thus forming a hermetic seal. Unfortunately, when the glass melts, it flows into the airline, thus degrading the electrical performance of the transmission line.

Since a slight gap must be present between the glass cylinder and the housing wall to allow the cylinder to be inserted into the wall, a longer length of glass material is required to ensure that, after melting, the glass completely fills the cylindrical hole. During heating, the glass adheres to the center pin in the area beyond the surface of the housing wall. As the glass contracts into the hole, a meniscus is formed between the connector pin and the outside edge at the housing-glass interface. The curvature of the meniscus reduces the performance of the feedthrough. The meniscus is also brittle and is prone to cracking. It is possible that the cracking of the meniscus can expose base kovan on the feedthrough pin.

SUMMARY AND OBJECTS OF THE INVENTION

Accordingly, it is an object of this invention to provide a sealed radio frequency glass feedthrough which eliminates the flow of the glass into the airline.

It is another object of this invention to provide a sealed radio frequency glass feedthrough which reduces the curvature of the meniscus on the outside surface of the glass layer.

The attainment of these and related objects are achieved by using a second ring of a material with the same dielectric constant, a low loss tangent, and a high melting point positioned between the first ring and the airline section.

BRIEF DESCRIPTION OF THE DRAWINGS

The foregoing and other related objects of the invention should be more readily apparent to those skilled in the art, after review of the following more detailed description of the invention, taken together with the accompanying drawings which.

DETAILED DESCRIPTION OF THE PREFERRED EMBODIMENTS

Figure 1A:
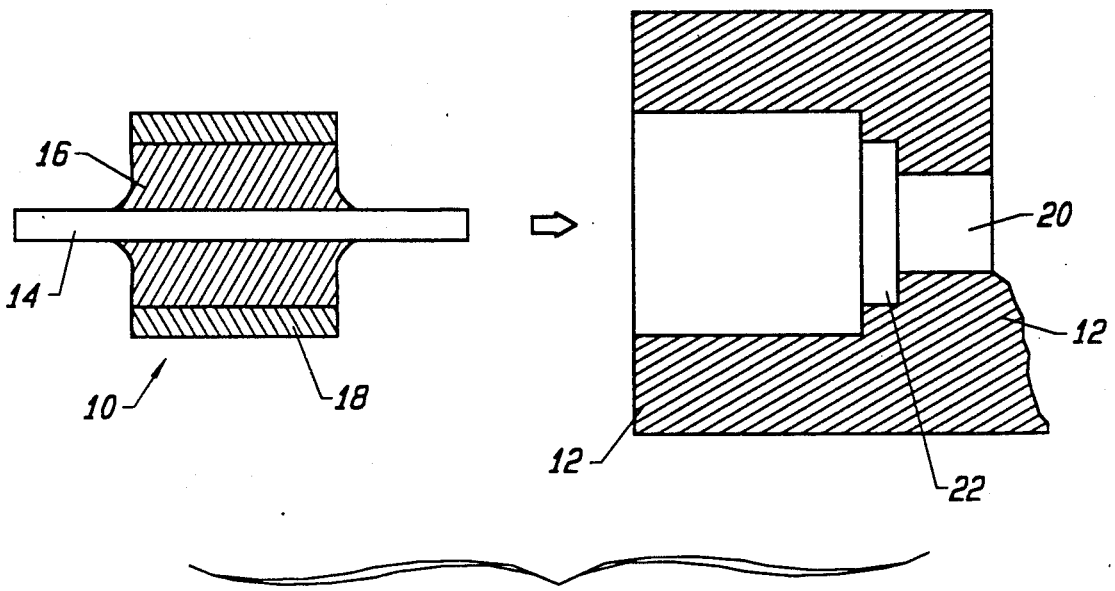
FIG. 1A PRIOR ART
FIG. 1A is a cross sectional preassembled view of a prior art soldered radio frequency feedthrough.
Figure 1B:
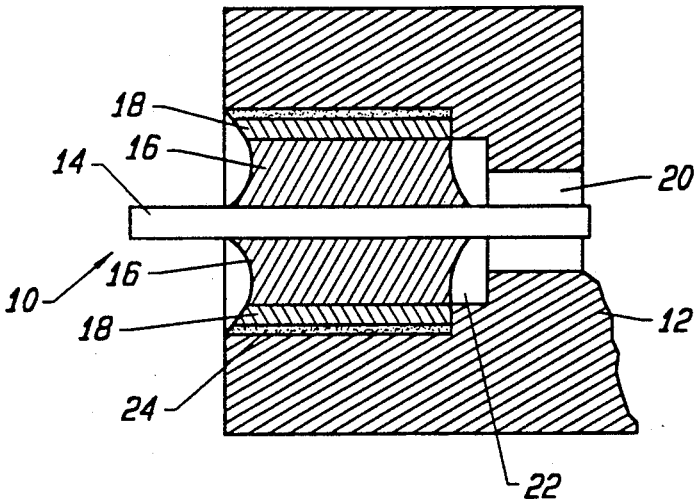
FIG. 1B PRIOR ART
FIG. 1B is a cross sectional assembled view of the prior art soldered radio frequency feedthrough of FIG. 1A.

FIG. 1A and 1B show a prior art radio frequency glass feedthrough. FIG. 1A shows a preassembled cross-sectional view of the prior art feedthrough. This feedthrough includes a coaxial feedthrough pin insert 10. The coaxial feedthrough pin insert 10 includes a conductive radio frequency feedthrough pin 14 surrounded by an inner concentric ring of glass 16 and an outer concentric ring of kovar 18. The insert 10 is inserted into the feedthrough housing 12 to assemble the feedthrough.

FIG. 1B shows the assembled feedthrough. The feedthrough insert 10 is soldered to the housing with solder material 24 to make the seal. Adjacent to the glass ring is a cylindrical airline section 20. In order to maintain a characteristic impedance throughout the feedthrough, the airline section is of a smaller diameter than the glass section. This smaller diameter creates a much smoother transition of the radio frequency signal from the feedthrough pin 14 to the components within the device. A discontinuity capacitance compensation section 22 is placed between the glass ring and the airline section to reduce the disturbance caused by the step change in diameter between the glass section and airline section.

There are several types of problems with this type of sealed feedthrough. The thermal expansion coefficient differential between the solder material 24 and the housing material 12 causes leaks in the seal when subjected to temperature variations. Also, the soldered seal is very brittle and is prone to cracking.

Figure 2:
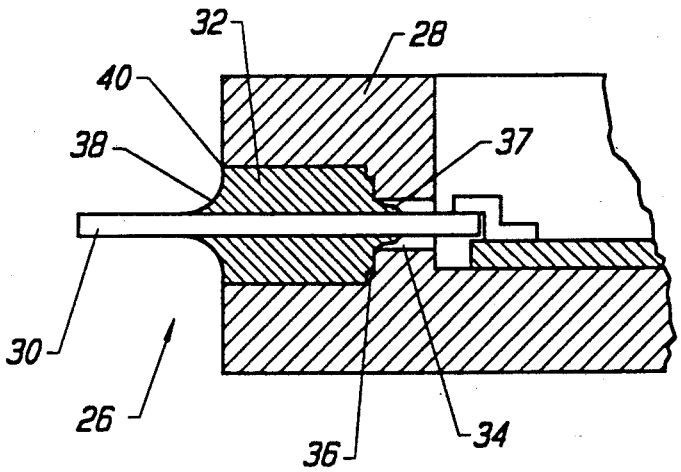
FIG. 2 is a cross sectional view of a prior art glass sealed radio frequency feedthrough.

To overcome these problems caused by the soldered seal, feedthrough inserts have been connected directly to the housing without the need for the solder. This type of feedthrough is shown in FIG. 2. As with the feedthrough of FIG. 1, this feedthrough includes a coaxial feedthrough pin insert 26 extending through the housing 28 of an RF device. The coaxial feedthrough pin insert 26 consists of a conductive radio frequency feedthrough pin 30 and a concentric ring of glass 32. The feedthrough also includes an airline section 34 and a discontinuity capacitance compensation section 36.

The insert 26 is then heated to a temperature greater than the melting temperature of the glass. This causes the glass ring to melt and bond to the housing 28 to form a hermetic seal. Unfortunately, when the glass is melted, some of the glass flows into the airline as indicated by reference numeral 37, thus degrading the electrical performance of the feedthrough.

Also, because the glass ring contracts when heated, an extra amount of initial glass material is required to ensure that, after the contraction, the glass is flush with the outside of the housing. During heating, this extra material adheres to the feedthrough pin and the outside edge of the housing. As the glass contracts, a meniscus 38 is formed between the feedthrough pin 30 and the outside edge of the housing-glass interface 40. The curvature of the meniscus reduces the performance of the feedthrough. The meniscus is also brittle and is prone to cracking. It is possible that the cracking of the meniscus can remove the protective layer on the feedthrough pin.

Figure 3:
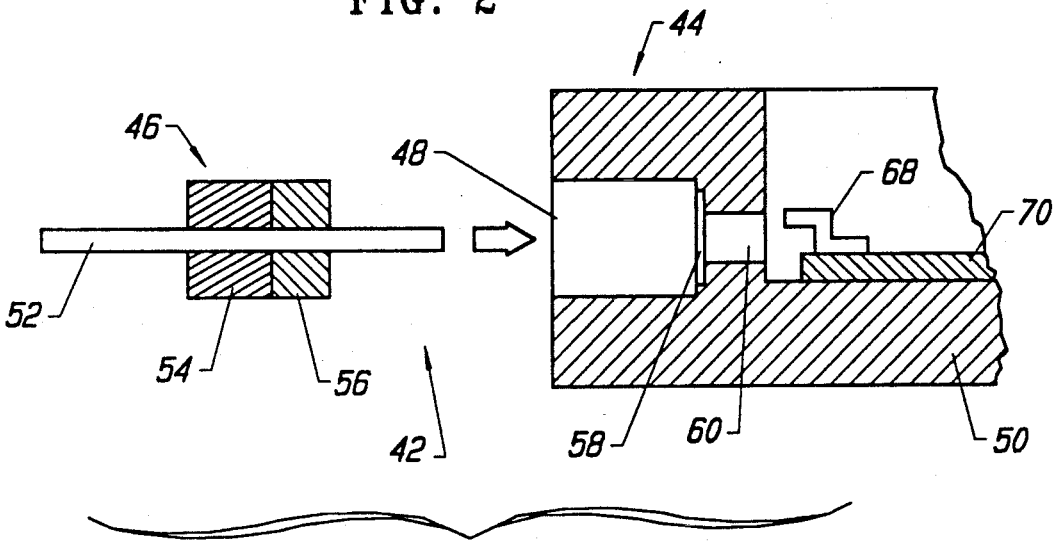
FIG. 3 shows a cross sectional disassembled view of a preferred embodiment of the sealed radio frequency feedthrough.

FIG. 3 shows a cross sectional view of a preferred embodiment of the present invention. The feedthrough 42 is shown in disassembled form to illustrate how the feedthrough is assembled. The feedthrough 42 allows the transmission of radio frequency signals through the wall of the housing 44. The feedthrough pin and housing are connected to other radio frequency devices via transmission lines, not shown.

The feedthrough 42 comprises a coaxial radio frequency transmission line which includes a conductive radio frequency feedthrough pin 52, a first ring 54 of a dielectric material with a low loss tangent such as glass, and a second ring 56 of a dielectric material with a low loss tangent and a high melting temperature. To form the assembled feedthrough, the coaxial feedthrough pin insert 46 is inserted into cavity 48 in housing 50 as shown. The feedthrough is then sealed to the housing 50 of the radio frequency device by heating the housing 50 and the insert 46 to a temperature which causes the glass 54 to melt and bond to the housing. The second dielectric material 56 is not melted in this process.

Figure 4:
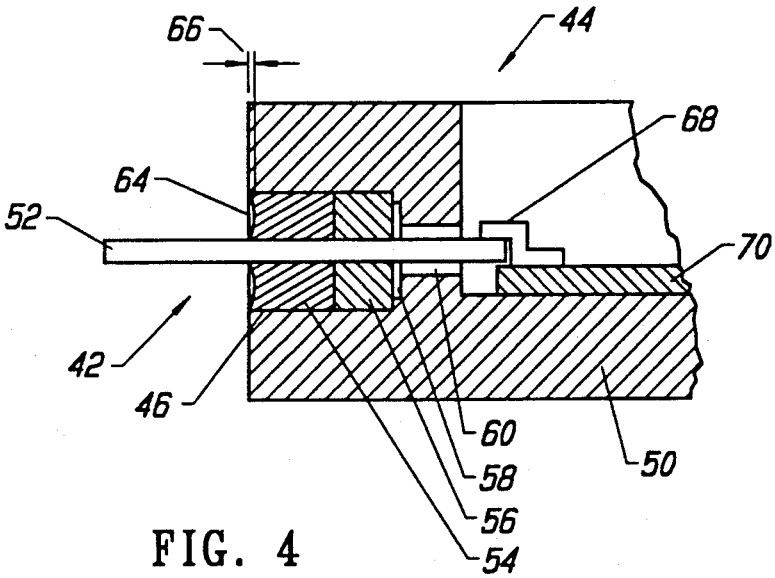
FIG. 4 is a cross sectional assembled view of a preferred embodiment of the sealed radio frequency feedthrough.

FIG. 4 shows a cross sectional assembled view of the feedthrough of FIG. 3. Adjacent to the second ring is discontinuity compensation section 58 and an airline section 60. The airline section 60 creates a much smoother transition of the radio frequency signal from the feedthrough pin 52 to the circuitry 70 within the device. The discontinuity capacitance compensation section 58 reduces the disturbance caused by the step change in diameter between the second ring 56 and the airline section 60. The radio frequency pin 52 lines up with microstrip 68 to connect the pin 52 to circuitry 70.

Preferably, the first ring 54 is composed of 7070 glass, manufactured by Corning. The second ring 56 is preferably made of quartz or boron nitride, although any material with a low loss tangent, a high melting temperature, and dielectric constant substantially close to that of the first ring will be satisfactory. The melting temperature of the second ring 56 is sufficiently higher than the melting temperature of the first ring 54 to prevent the second ring 56 from melting during the melting of the first ring 54. This prevents liquid glass from flowing into the airline section 60 when the glass ring 54 is "fired into" the housing 50. When the insert is heated to create the sealed connection between the housing 50 and the coaxial feedthrough pin insert 46, the second ring does not melt, thus blocking the flow of glass into the airline section 60 and preserving the characteristic impedance of the air line 60 and the compensation step 58.

The presence of the second ring 56 of high melting temperature material in the feedthrough pin insert 46 makes it possible to reduce the amount of glass material in the insert. This smaller amount of glass exhibits less contraction during the firing process and therefore allows for a reduction of the initial amount of extra glass required to account for this contraction. This reduced amount of contraction reduces the size and curvature of the meniscus 64 (FIG. 4) formed between the radio frequency pin 52 and the housing 50, thus reducing the set-back 66 (formed by the meniscus) of the outside edge of the feedthrough. The resulting flatter surface improves the performance and repeatability of the feedthrough. Preferably, the device housing 50 and pin 52 have oxidized surfaces The oxidized surfaces facilitate adhesion by the melted glass.

It should further be apparent to those skilled in the art that various changes in form and details of the invention as shown and described may be made. It is intended that such changes be included within the spirit and scope of the claims appended hereto.

What is claimed is:

1. A radio frequency hermetic feedthrough comprising:

(a) a center conductor pin with a central longitudinal axis;

(b) a first ring of low loss dielectric material surrounding a portion of said center pin at a first location on said central longitudinal axis; and (c) a second ring surrounding said center pin at a second location on said central longitudinal axis which is axially adjacent to said first location (adjacent to said first ring), said second ring formed of a low loss dielectric material with a high melting point relative to said first ring.

2. A radio frequency feedthrough pin seal as in claim 1 wherein said first ring is of a glass material.

3. A radio frequency feedthrough pin seal as in claim 1 wherein said second ring is of a material selected from the following group: quartz, boron nitride.

4. A radio frequency hermetic feedthrough comprising:

(a) a center conductor pin with a central longitudinal axis;

(b) a first ring of a low loss dielectric material surrounding a portion of said pin at a fist location said central longitudinal axis; and (c) a second ring surrounding said center pin at a second location on said central longitudinal axis which is axially adjacent to said first location(adjacent to said first ring), said second ring formed of a material with a low loss tangent, a high melting temperature relative to said first ring, and a dielectric constant substantially close to the dielectric constant of said first ring.

5. A radio frequency hermetic feedthrough comprising:

(a) a coaxial center pin insert comprising:

1. a radio frequency feedthrough pin with a central longitudinal axis;
2. a first ring of a low loss material surrounding a portion of said feedthrough pin at a first location on said central longitudinal axis; and
3. a second ring surrounding said feedthrough pin at a second location on said central longitudinal axis which is axially adjacent to said first location (adjacent to said first ring), said second ring formed of a material with a low loss tangent, high melting temperature relative to said first ring, and a dielectric constant substantially close to the dielectric constant of said first ring; and (b) a radio frequency device comprising:

1. a housing defining a cavity for holding said insert, said cavity including an airline section to improve transition from said center pin to said device.

6. A radio frequency hermetic feedthrough as in claim 5 wherein said radio frequency device further includes a discontinuity capacitance compensation section located in said cavity to compensate for the discontinuity between said second ring and said airline section.

7. A method of forming a hermetic radio frequency connection comprising the steps of:

(a) inserting a coaxial pin (insert) into a feedthrough housing, said coaxial pin (insert) comprising a radio frequency feedthrough pin with a central longitudinal axis, a first ring of a low loss glass material surrounding said pin at a first location on said central longitudinal axis, a second ring surrounding said feedthrough pin at a second location on said central longitudinal axis which is axially adjacent to said first location (adjacent to said first ring), said second ring formed of a material with a low loss tangent, high melting temperature relative to said first ring, and a dielectric constant substantially close to the dielectric constant of said first ring; and (b) heating said insert so that said first ring melts and adheres to the walls of said housing while said second ring remains in a solid form.

* * * * *

UNITED STATES PATENT AND TRADEMARK OFFICE

CERTIFICATE OF CORRECTION

PATENT NO. : 5,170,142

DATED : December 8, 1992

INVENTOR(S) : Larry J. Bier

It is certified that error appears in the above-identified patent and that said Letters Patent is hereby corrected as shown below:

Column 1, line 54, "kovan" should be --kovar--.

Signed and Sealed this

Twenty-third Day of November, 1993

*Attest:*

Bruce Lehman

BRUCE LEHMAN

*Attesting Officer*

*Commissioner of Patents and Trademarks*